US006129592A

United States Patent [19]

Mickievicz et al.

[11] Patent Number: 6,129,592

[45] Date of Patent: Oct. 10, 2000

[54] CONNECTOR ASSEMBLY HAVING TERMINAL MODULES

[75] Inventors: Scott Keith Mickievicz, Elizabethtown; George Preputnick, Harrisburg, both of Pa.

[73] Assignee: The Whitaker Corporation, Wilmington, Del.

[21] Appl. No.: 09/184,872

[22] Filed: Nov. 3, 1998

Related U.S. Application Data

[60] Provisional application No. 60/064,262, Nov. 4, 1997.

[51] Int. Cl.[7] ..... H01R 13/502

[52] U.S. Cl. ..... 439/701

[58] Field of Search ..... 439/79, 607, 701, 439/590, 682

[56] References Cited

U.S. PATENT DOCUMENTS 3,865,462 2/1975 Cobaugh et al. .
4,548,457 10/1985 Derr .
4,737,115 4/1988 Seidler ..... 439/83
4,820,182 4/1989 Harwath et al. ..... 439/290
4,887,976 12/1989 Bennett et al. ..... 439/492
5,066,236 11/1991 Broeksteeg ..... 439/79
5,496,183 3/1996 Soes et al. ..... 439/79
5,975,917 11/1999 Wang et al. ..... 439/79

*Primary Examiner*—Khiem Nguyen

[57] ABSTRACT

An electrical connector assembly (30) includes an insulating housing (32) and assembled thereto a plurality of terminal modules (50). Each terminal module (50) has a plurality of terminals (56), each including a cantilevered beam (58) having a protuberance (59) at the leading end thereof, a conductor connecting portion (62) and an intermediate portion (60) therebetween encapsulated in an insulative web (76). The beams (58) of all the terminals (56) extend in a single line. The protuberances (59) of a first group (64) of adjacent terminals (56) in the row extend in one direction in the single line and the protuberances (59) of the beams of a second group (66) extend in an opposite direction in the single line.

6 Claims, 6 Drawing Sheets

CONNECTOR ASSEMBLY HAVING TERMINAL MODULES

This application claims the benefit of U.S. Provisional Application No. 60/064,262, filed Nov. 4, 1997.

FIELD OF THE INVENTION

This invention relates to electrical connector assemblies having terminal modules.

BACKGROUND OF THE INVENTION

It is common, in the electronics industry, to use right angled connectors for electrical connection between two printed circuit boards, between circuit boards and a backplane, or between a printed circuit board and conducting wires. The right angled connector typically has a large plurality of pin receiving terminals and, at right angles thereto, pins (for example compliant pins) that make electrical contact with a printed circuit board. Post headers on another printed circuit board or a post header connector can thus be plugged into the pin receiving terminals making electrical contact therebetween. As the needs of the industry expand, the connectors need to have additional capability, that is more terminals and signal lines. It is desirable, however, that the exterior dimensions at the mating face of the more highly dense connectors are essentially the same size as those of the connectors having fewer terminals. Thus, the spacing and number of header connectors that can be mounted on the mother board or back plane can remain essentially the same.

Cost effective and simple designs of right angle connectors have been discussed in U.S. Pat. Nos. 5,066,236 and 5,496,183. In such connectors the modular design makes it easy to produce shorter or longer connectors without redesigning and tooling up for a whole new connector but by producing only a new housing part into which a plurality of identical terminal modules are assembled.

SUMMARY OF THE INVENTION

One object of the present invention is to provide a multi-module connector having a high density while maintaining essentially the same mating face dimensions as those of a less dense connector. In accordance with the invention, each electrical terminal module has a housing with plurality of terminals therein. Each of the terminals has a cantilevered beam, and the beams of all of the terminals extend in a single plane from a forward face of the module housing. The beams are adapted to be received in respective passageways of a multi-module connector housing with the leading edges of the beams being adjacent a mating face of the multi-module connector housing.

Each beam has a protuberance adjacent the leading end to define a contact surface for engagement with a mating terminal. The protuberances of respective beams in a first group of adjacent ones of the terminals in the row extend in one direction in the single plane and the protuberances of the respective beams of a second or remaining group of terminals extend in an opposite direction in the single plane. Upon engagement of the protuberances and deflection of the beams by corresponding terminals of a mating connector, forces generated by the first group resisting deflection are counterbalanced by forces generated by the second group, thereby applying no moment to the mating connector.

The invention will now be described by way of example with reference to the following drawings.

DETAILED DESCRIPTION OF AN EMBODIMENT OF THE INVENTION

For purposes of illustration the invention will be described in terms of an eight row connector of the prior art and a twelve row connector made in accordance with the invention. It is to be understood that the invention may be used with other connectors as well.

Figure 1:
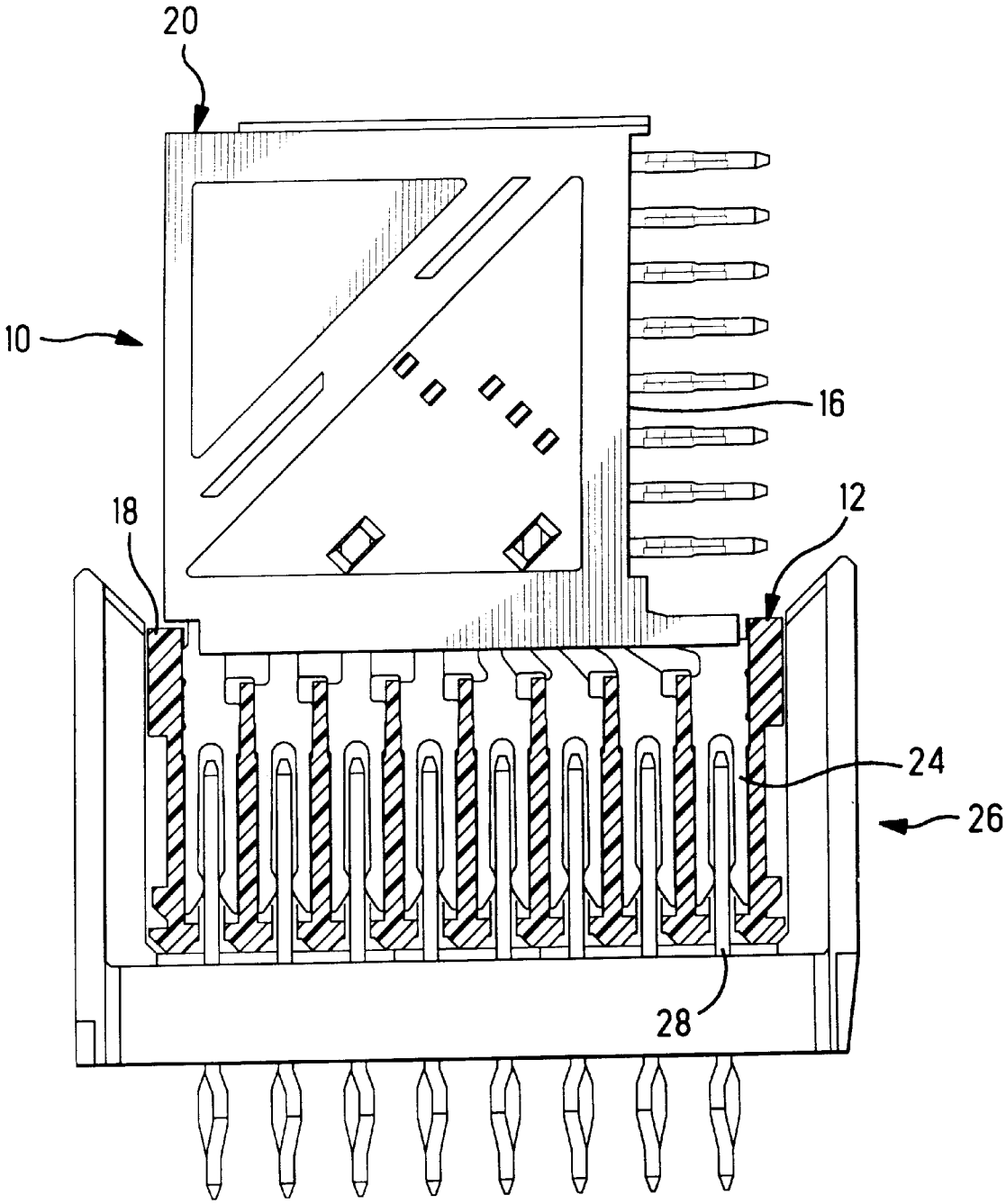
FIG. 1 Prior Art
FIG. 1 is a cross-sectional view of a prior art connector having a plurality of terminal modules mated to a pin header.
Figure 2:
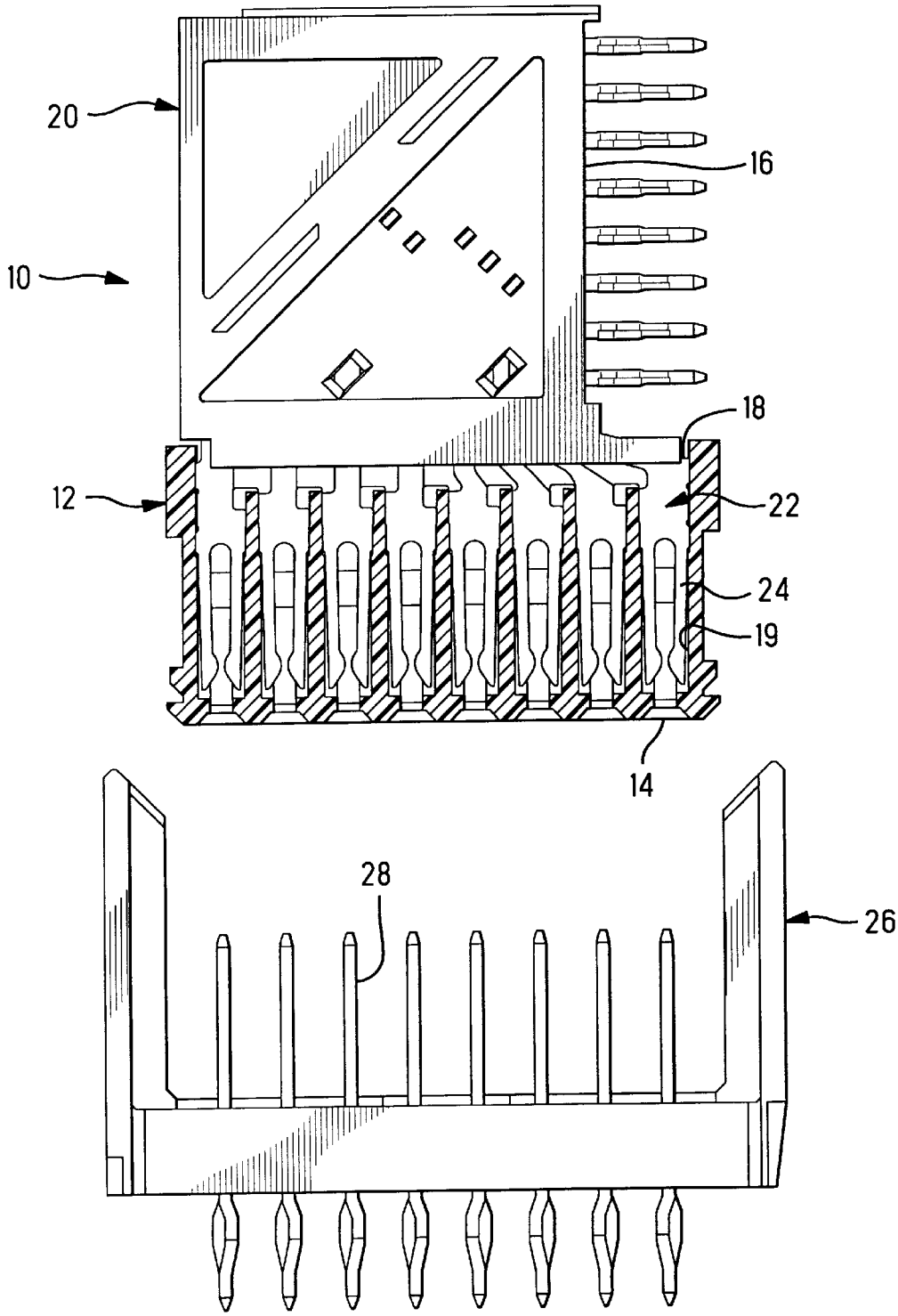
FIG. 2 Prior Art
FIG. 2 is a cross-sectional view of the prior art connector of FIG. 1 exploded from the pin header.

FIGS. 1 and 2 are cross-sectional views of a prior art connector 10 having a housing 12 and a plurality of terminal modules 20. Housing 12 includes a mating face 14, a mounting face 16, an assembly face 18 and a plurality of terminal receiving passageways 19 extending from the mating face 14 to the assembly face 18. Terminal modules 20 include a plurality of terminals 22, each having mating terminal portions 24 that are a pair of flat beams, known in the art as "tuning forks". Prior art connector 10 is shown mated to and exploded from a header 26 having a plurality of pin terminals 28.

Referring now to FIGS. 3 through 7, the multi-module connector 30 of the present invention includes a housing 32 and a plurality of terminal modules 50. Housing 32 includes a mating face 34, a mounting face 36, an assembly face 38 and a plurality of terminal receiving passageways 44 extending from the mating face 34 to the assembly face 38. Terminal modules 50 include a plurality of terminals 56, each having a cantilevered beam 58 for engagement and deflection by a corresponding pin terminal 82 of mating connector 80, a board connecting portion 62 for connection to a printed circuit board (not shown), and an intermediate portion 60 extending therebetween.

Figure 4:
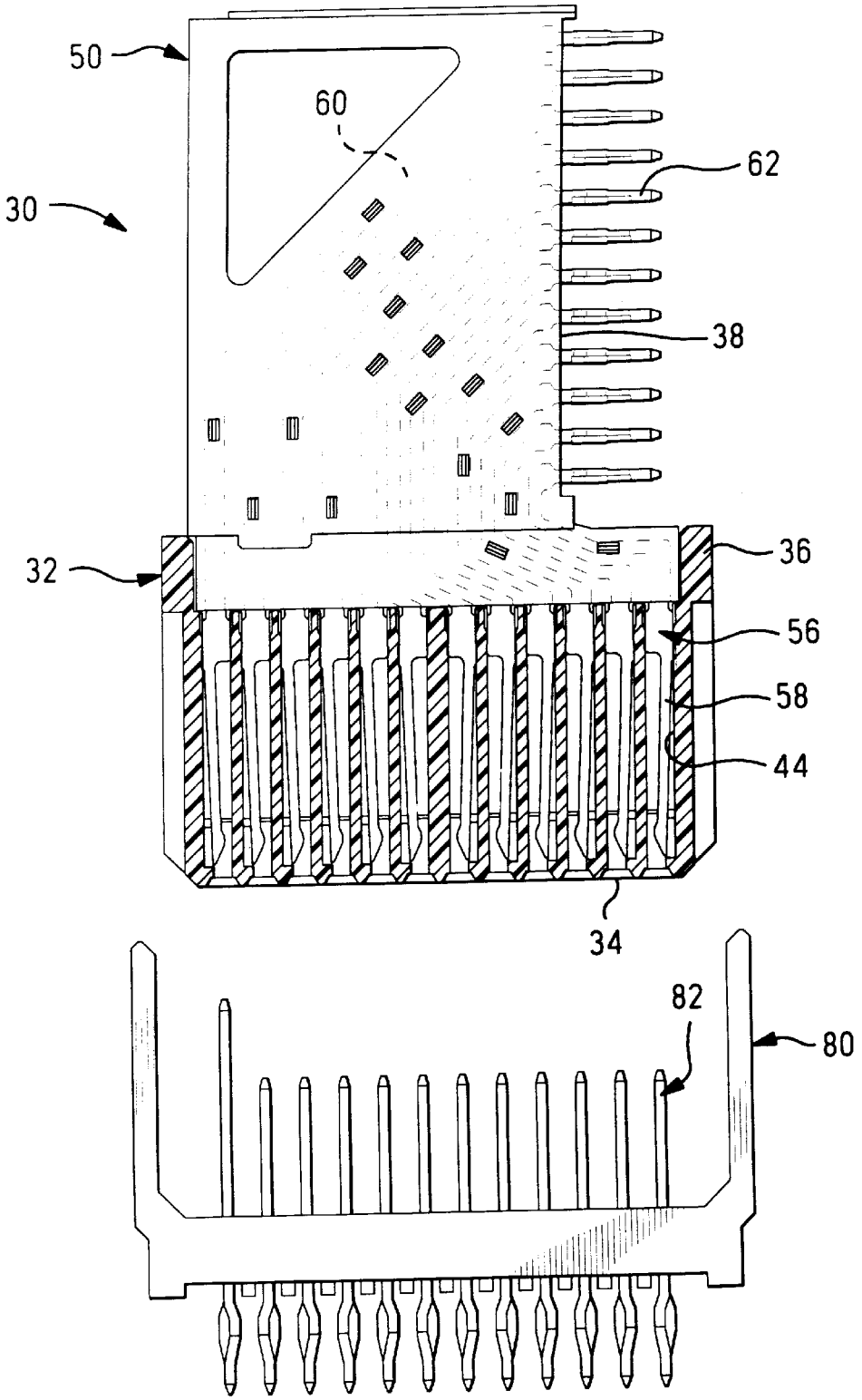
FIG. 4 is a cross-sectional view of the connector of FIG. 3 exploded from the pin header.
Figure 5:
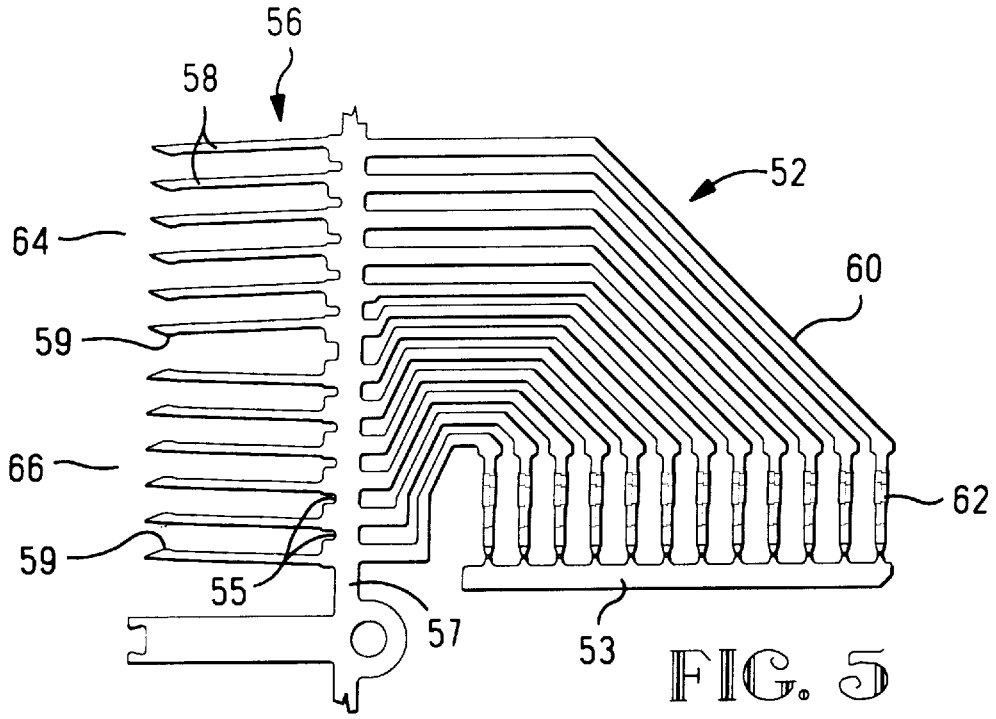
FIG. 5 is a plan view of a terminal lead frame used in the modules of the connector of FIG. 3.
Figure 6:
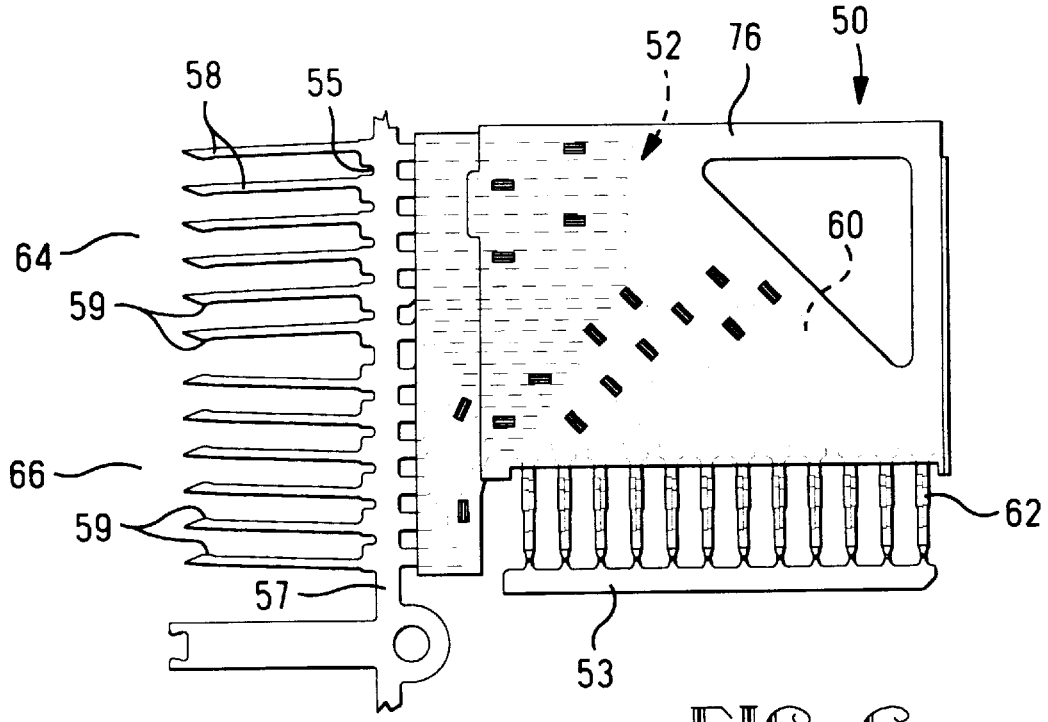
FIG. 6 is a plan view of a module used in the connector of FIG. 3.

The terminal modules 50 are shown in FIG. 5 as partially manufactured terminal lead frames 52 having a plurality of edge stamped terminals 56 which are shown still connected to carrier strips 53 and 57. The cantilevered beams 58 of terminals 56 have a "D" shaped protuberance 59 at the leading end. As best seen in FIGS. 4 through 6 the protuberances 59 at the leading ends of the beams 58 in a first group 64 of the lead frame 52 face in one direction and the protuberances 59 at the leading ends of the beams 58 in a second group 66 of lead frame 52 face in the opposite direction. The board connecting portions 62 are shown as compliant pins, but solder tails may also be used.

After stamping of the terminal arrays 52, as shown in FIG. 5, an insulative web generally shown as 76 is molded over the intermediate portions 62, as shown in FIG. 6. The carrier strips 53, 57 and the bridges 55 between the cantilevered beams 58 are cut away after the overmolding process.

Figure 3:
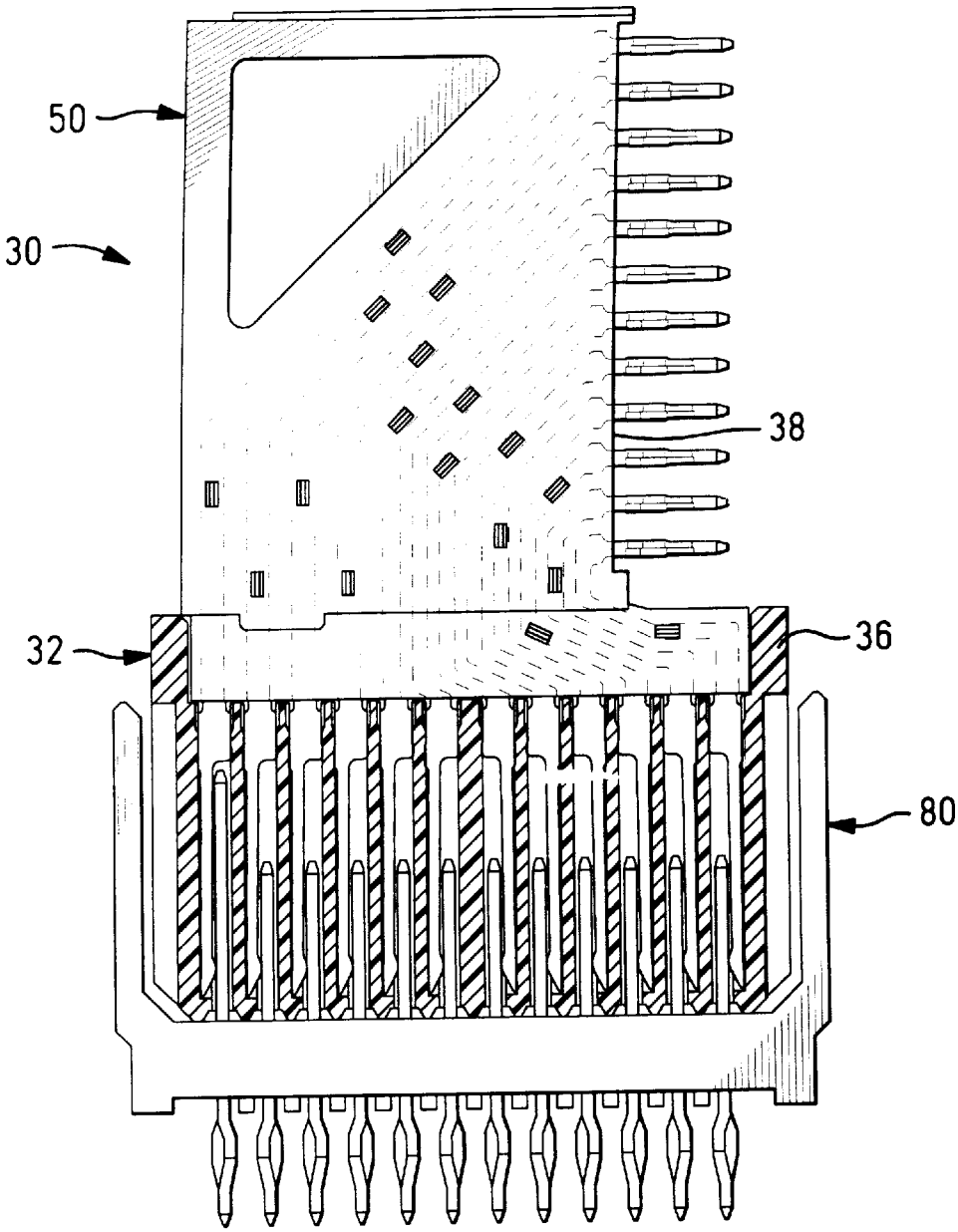
FIG. 3 is a cross-sectional view of a connector having a plurality of terminal modules made in accordance with the invention mated to a pin header.
Figure 7:
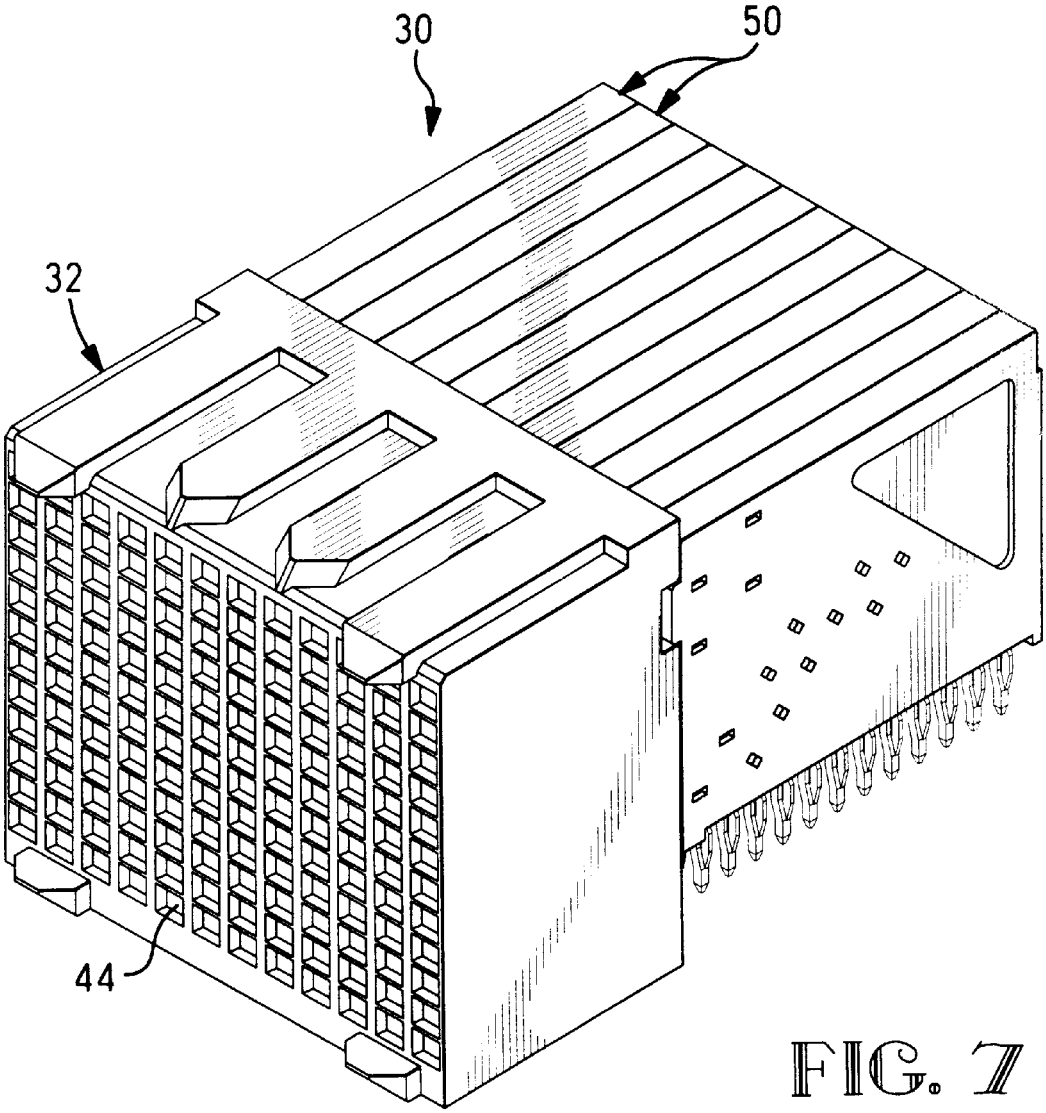
FIG. 7 is an isometric view of a multi-module connector made in accordance with the invention.

The terminal modules 50 of FIG. 6 are then assembled side by side to the back of multi-module housing 32 in a manner similar to that disclosed in U.S. Pat. Nos. 5,066,236 and 5,496,183 and as shown in FIG. 7. The cantilevered beams 58 are disposed in respective terminal receiving passageways 44 and, upon mating connector 30 to connector 80, the beams 58 are engaged and deflected by respective complementary pin terminals 82, as shown in FIG. 3. The connecting terminal ends 62 are for electrical contact with through-holes of a printed circuit board (not shown).

The structure of the modules of the present invention provides two groups of terminals in a single plane or row. The first group of adjacent terminals have protuberances of respective beams thereof extending in one direction in the single plane and a second or remaining group of terminals have protuberances of respective beams of extending in an opposite direction in the single plane. Upon engagement of the protuberances and deflection of the beams by corresponding terminals of a mating connector, as shown in FIG. 3, forces generated by the first group resisting deflection are counterbalanced by forces generated by the second group, thereby applying no moment to the mating connector.

In addition, the single beams provide a lower mating force per square inch of connector than the tuning fork design of the prior art. In one embodiment, the number of rows of terminals is increased by fifty per cent and the overall width of the connector at the mating face is only increased by about ten per cent.

It is thought that the connector assembly with modules of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An electrical terminal module comprising:

a housing that holds a plurality of discrete terminals, each of said terminals having a cantilevered beam, the beams of all of said terminals extending in a single plane from a forward face of said module housing, each said beam having a leading end and a protuberance adjacent said leading end to define a contact surface for engagement with a mating terminal;

a first group of said terminals having said protuberances extending only in one direction in said single plane; and a second group of said terminals having said protuberances extending only in an opposite direction from said one direction;

whereby upon engagement of said protuberances and deflection of said beams by corresponding terminals of a mating connector, forces generated by said first group resisting deflection are counterbalanced by forces generated by said second group, thereby applying no moment to the mating connector.

2. The electrical terminal module of claim 1 wherein said terminals in said first group are adjacent one another and said terminals in said second group are adjacent one another.

3. The electrical terminal module of claim 1 wherein said protuberances of said first group of terminals face toward the protuberances of said second group of terminals.

4. An electrical connector assembly, comprising:

an insulative connector housing and a plurality of terminal modules inserted therein, each said terminal module including an insulative module housing that holds a plurality of discrete terminals;

each of said terminals having a cantilevered beam, the beams of all of said terminals extending in a single plane from a forward face of said module housing, each said beam having a leading end and a protuberance adjacent said leading end to define a contact surface for engagement with a mating terminal;

a first group of said terminals having said protuberances extending only in one direction in said single plane; and a second group of said terminals having said protuberances extending only in an opposite direction from said one direction;

whereby upon engagement of said protuberances and deflection of said beams by corresponding terminals of a mating connector, forces generated by said first group resisting deflection are counterbalanced by forces generated by said second group, thereby applying no moment to the mating connector.

5. The electrical terminal module of claim 4 wherein said terminals in said first group are adjacent one another and said terminals in said second group are adjacent one another.

6. The electrical terminal module of claim 4 wherein said protuberances of said first group of terminals face toward the protuberances of said second group of terminals.

* * * * *